US007482979B2

(12) United States Patent
Chiang

(10) Patent No.: US 7,482,979 B2
(45) Date of Patent: Jan. 27, 2009

(54) STACKED MONOPOLE ANTENNA FOR BROADBAND COMMUNICATION EQUIPMENT

(75) Inventor: Chi-Ming Chiang, Pateh (TW)

(73) Assignee: Auden Techno Corp., Tao-Yuan Hsien (TW)

( * ) Notice: Subject to any disclaimer, the term of this patent is extended or adjusted under 35 U.S.C. 154(b) by 174 days.

(21) Appl. No.: 11/495,686

(22) Filed: Jul. 31, 2006

(65) Prior Publication Data

US 2008/0024383 A1 Jan. 31, 2008

(51) Int. Cl.
*H01Q 1/38* (2006.01)

(52) U.S. Cl. ..... 343/700 MS; 343/702; 343/895

(58) Field of Classification Search ..... 343/750, 343/802, 803, 804, 805, 806, 828, 700 MS, 343/702, 895

See application file for complete search history.

(56) References Cited

U.S. PATENT DOCUMENTS 6,924,770 B2 * 8/2005 Carpenter et al. ..... 343/702
2006/0135061 A1 * 6/2006 Ying ..... 455/19

* cited by examiner

*Primary Examiner*—Trinh V Dinh
*Assistant Examiner*—Dieu Hien T Duong

(57) ABSTRACT

A stacked monopole antenna for broadband communication equipment, the antenna is provided with a plurality of component sheets arranged from bottom to top, a gap for adjusting impedance matching is provided between every two component sheets, and the component sheets form centrally thereof an integral connecting neck, a feed-in line is provided on the bottom of the antenna; the component sheets get its desired broad bandwidth by adjusting the height stacked by said component sheets.

2 Claims, 6 Drawing Sheets

STACKED MONOPOLE ANTENNA FOR BROADBAND COMMUNICATION EQUIPMENT

BACKGROUND OF THE INVENTION

1. Field of the Invention

The present invention is related to a stacked monopole antenna for broadband communication equipment, and especially to a miniaturized stacked antenna having excellent gain and feature of broadband.

2. Description of the Prior Art

The industry of communication equipment keeps on stably developing in the recent years following fast growth of the markets of electric communication, particularly the markets of mobile phones. By virtue that requirement on the multi-frequency mobile phones increases rapidly, the antennas for such communication equipments thereby are supposed to be able to operate with more than two frequencies.

At the same time, volumes of modern mobile phones are largely reduced, this makes a huge pressure to promote miniaturization of antennas; and this is because mainly of the fact that the miniaturization of antennas will render the gains and bandwidths of the antennas limited.

In order to miniaturize antennas and to hide antennas with small lengths in mobile phones, it has been the inevitable tendency that built-in antennas with reduced volumes are used to substitute for exposed helix antennas. When it is desired to hide such a miniaturized antenna in a communication equipment, designing for the antenna shall include the factors of: ability of generating a broadband, ability of easy impedance matching with a feed-in line and having reduced volume; however, a broadband antenna now available evidently is hard to meet the requirement of the designing nor to have a good function of receiving and emitting signal.

SUMMARY OF THE INVENTION

The main object of the present invention is to provide a stacked monopole antenna for broadband communication equipment that can have excellent gain and feature of broadband, and that has operational frequencies suiting the systems including CMDA (code vision multiple access) system, Pan Europe mobile phone system, digital communication system, personal communication system, personal mobile phone system and broadband code vision multiple access system.

To get the above stated object, an antenna of the present invention is provided with a plurality of component sheets arranged from bottom to top, a gap for adjusting impedance matching is provided between every two component sheets, and component sheets form centrally an integral connecting neck, a feed-in line is provided on the bottom of the antenna; the component sheets get its desired broad bandwidth by adjusting the height stacked by said component sheets.

In a feasible embodiment, the above component sheets form together from bottom to top a sheet member or are stacked to form a barrel.

In a preferred embodiment, the above component sheets form together a triangular sheet member with the areas of the component sheets gradually reduced from bottom to top, and are stacked to form a triangular cone.

In another feasible embodiment, the above component sheets form together a polygonal sheet member, and are stacked to form a polygonal barrel.

In another feasible embodiment, the above component sheets form together a rectangular sheet member, and are stacked to form a rectangular stacked antenna.

The present invention will be apparent in its characteristics after reading the detailed description of the preferred embodiment thereof in reference to the accompanying drawings. Wherein:

DETAILED DESCRIPTION OF THE PREFERRED EMBODIMENT

Figure 1:
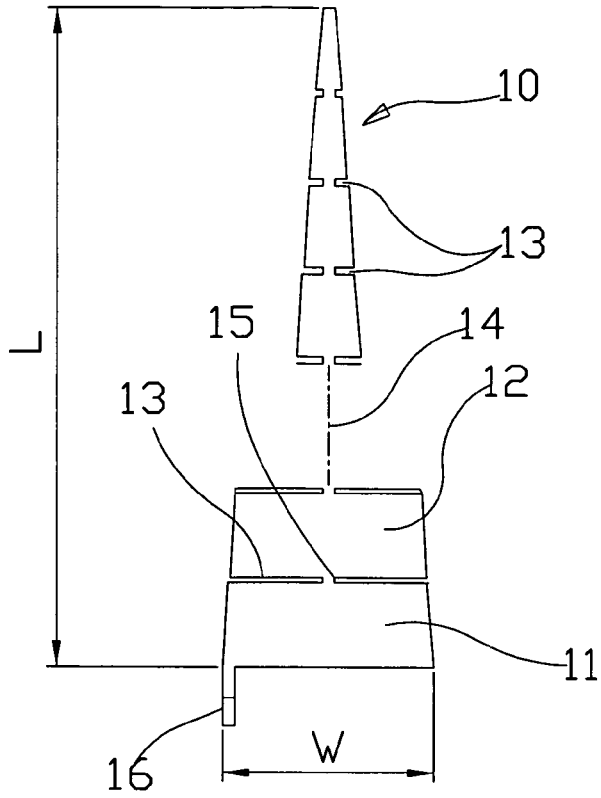
FIG. 1 is a plane view showing the first embodiment of the present invention.

Referring firstly to FIG. 1, a monopole antenna 10 in this first embodiment is made of metal (such as copper) and punching formed into a triangular radiation element, its frequencies cover the CMDA (code vision multiple access) system (824-894 MHZ), the Pan Europe mobile phone system (GSM, 880-960 MHZ), the digital communication system (DSC, 1710-1880 MHZ), the personal communication system (PCS, 1850-1990 MHZ), the personal mobile phone system (PHS, 1905-1920 MHZ) and the broadband code vision multiple access system (WCDMA, 2010-2025 MHZ).

In the above first embodiment of the present invention, the monopole antenna 10 is provided with a plurality of component sheets 11, 12, . . . arranged from bottom to top, an adjustable gap 13 is provided between every two component sheets 11, 12 . . . . In this embodiment, the gap 13 is provided to make the monopole antenna 10 have a set distance starting from the central line 14 to an edge of each of the component sheets 11, 12, . . . , so that the component sheets 11, 12, . . . form centrally an integral connecting neck 15 with a feed-in line 16 on the bottom of the monopole antenna 10.

In this preferred embodiment, the above component sheets 11, 12, . . . form together a triangular sheet member with the areas of the component sheets 11, 12, . . . reduced from bottom to top. Taking a normal mobile phone as an example, the gross length L of the monopole antenna 10 in the preferred embodiment is about 130 mm, a bottom width W is about 18 mm; when the height of each of the component sheets 11, 12, . . . is about 8 mm, the adjustable gap 13 is about 0.5 mm, and the feed-in line 16 is about 5 mm.

The impedance bandwidth and the impedance matching of the monopole antenna 10 can be adjusted in pursuance of the adjustable gap 13 formed between the component sheets 11, 12, . . . , its basic mode of resonance can be set to occur at 900 MHZ, and the gross length of the monopole antenna 10 can be decided as ¾ wavelength of the frequency of resonance.

Figure 3:
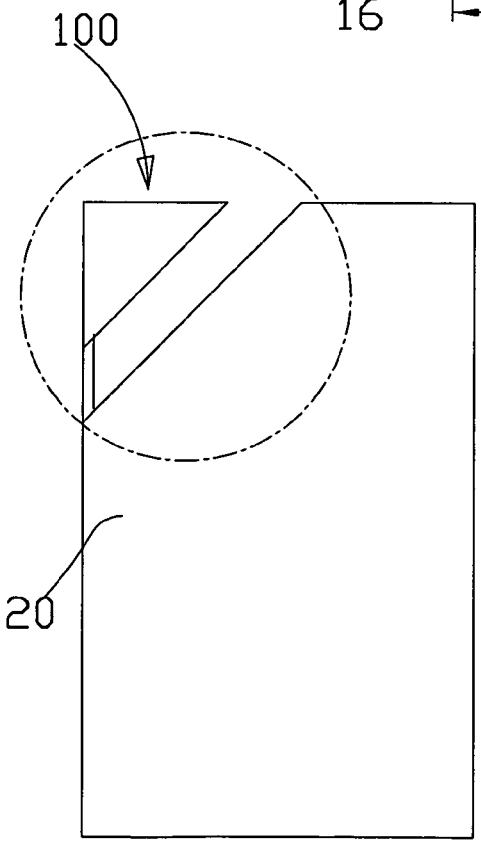
FIG. 3 is a plane view showing that the second embodiment of FIG. 2 is installed in a circuit board.
Figure 2:
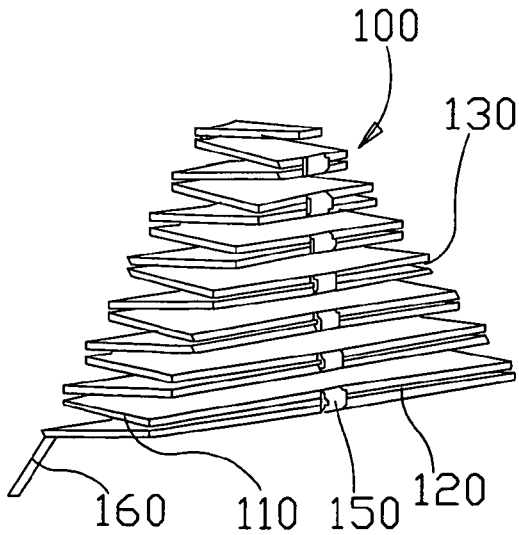
FIG. 2 is a perspective view showing the second embodiment of the present invention.

As shown in FIG. 2, in this second embodiment, the first embodiment (in FIG. 1) is processed by folding to form a barrel (this second embodiment forms a triangular cone), wherein similar members are given with similar numbers. An antenna 100 in this second embodiment similarly is provided with a plurality of component sheets 110, 120, . . . , an adjustable gap 130, an integral connecting neck 150 and a feed-in line 160, by a mode of processing of multi-folding, the component sheets 110, 120, . . . are folded and stacked to give the monopole antenna 10 a small height (about 10 mm). Thereby the entire monopole antenna 10 can be installed and connected to a circuit board 20 of a mobile phone as shown in FIG. 3.

Figure 4:
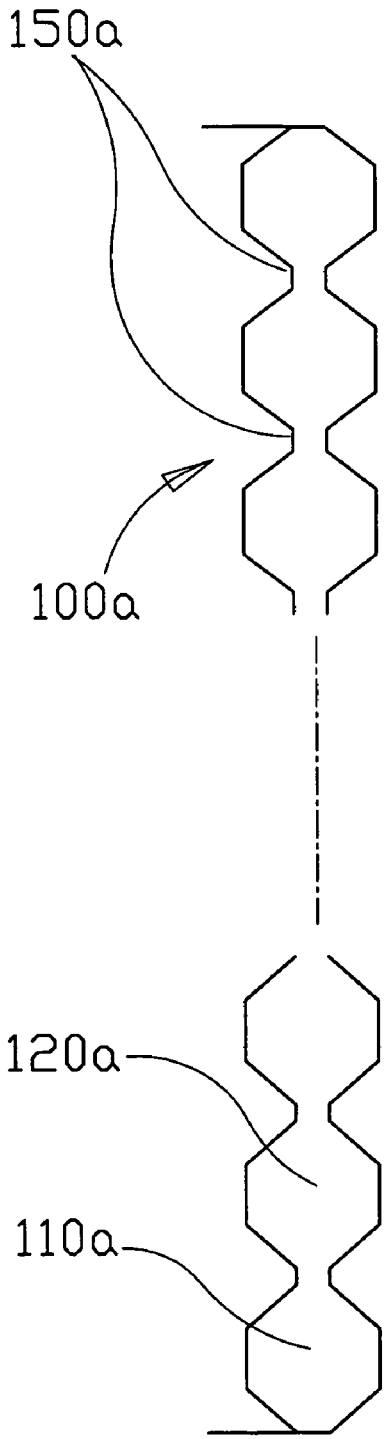
FIG. 4 is a plane view showing the third embodiment of the present invention.
Figure 5:
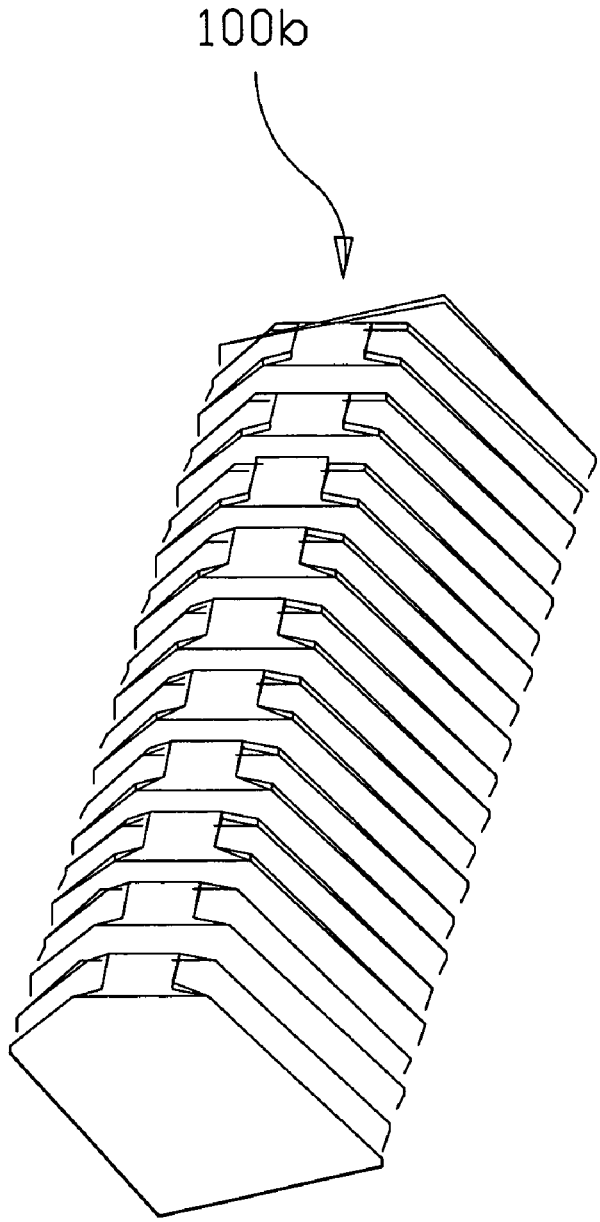
FIG. 5 is a perspective view showing the fourth embodiment of the present invention.
Figure 9:
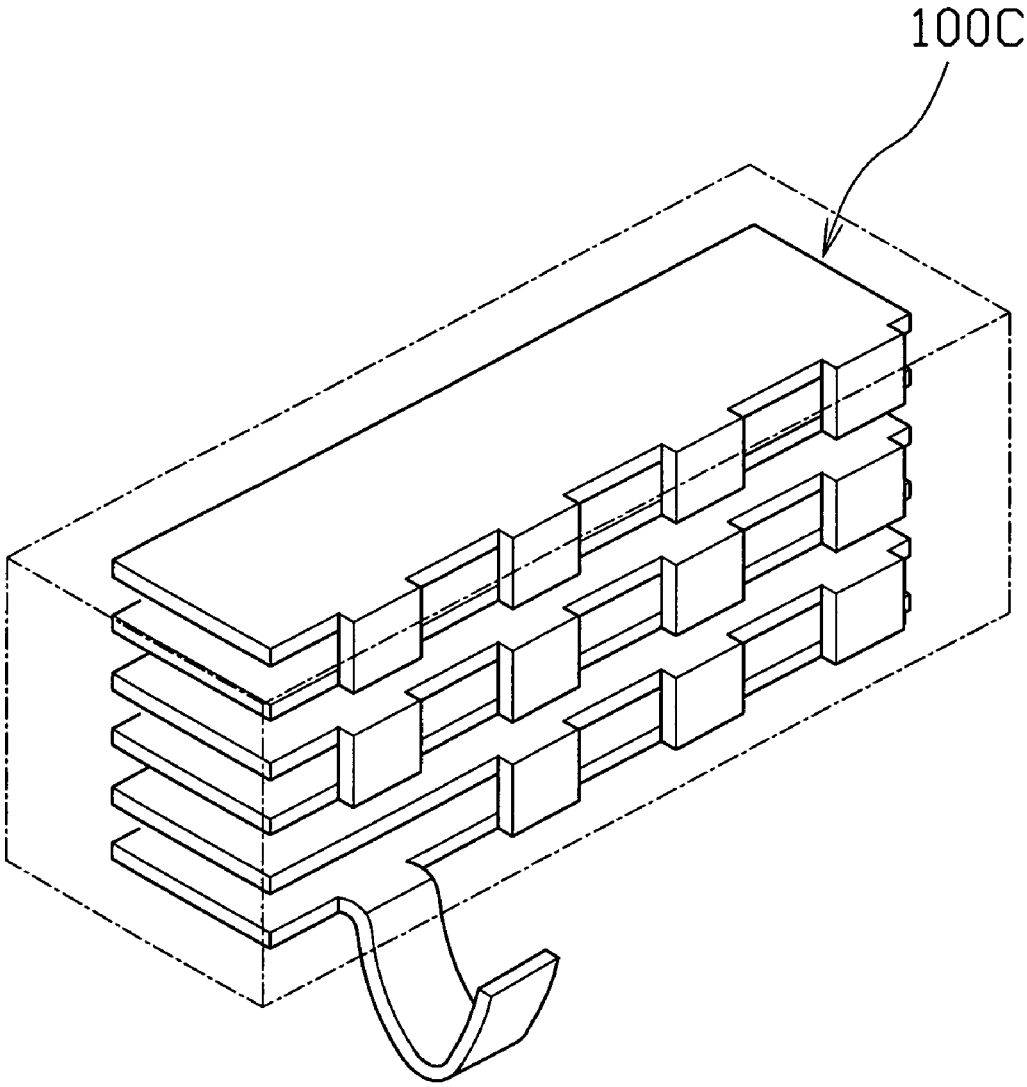
FIG. 9 is a perspective view showing the fifth embodiment of the present invention.

FIG. 4 shows a third embodiment of the present invention, an antenna 100*a* similarly has a plurality of component sheets 110*a*, 120*a*, . . . , an adjustable gap and an integral connecting neck 15*a*, the component sheets 110*a*, 120*a*, . . . are integrally connected to form a polygonal sheet member that is folded and stacked to form the stacked antenna 100*a*. FIG. 5 shows a fourth embodiment of the present invention using a polygonal stacked antenna 100*b* having a plurality of component sheets 110*b*, 120*b*, . . . in similarity to those of the third embodiment with a slight difference, the component sheets 110*b*, 120*b*, . . . are processed by folding and stacked to give the monopole antenna 100*b* a small height (about 20 mm). FIG. 9 shows a fifth embodiment of the present invention having a plurality of component sheets in similarity to those of the fourth embodiment, but the component sheets are rectangular and are stacked to form a rectangular stacked antenna 100*c*; and the antenna 100*c* is installed in a housing (as shown with dotted lined in the drawing), a feed-in line is extended out of the housing, each component sheet has a plurality of connecting necks provided separately in the middle between the two lateral sides of it.

Figure 6:
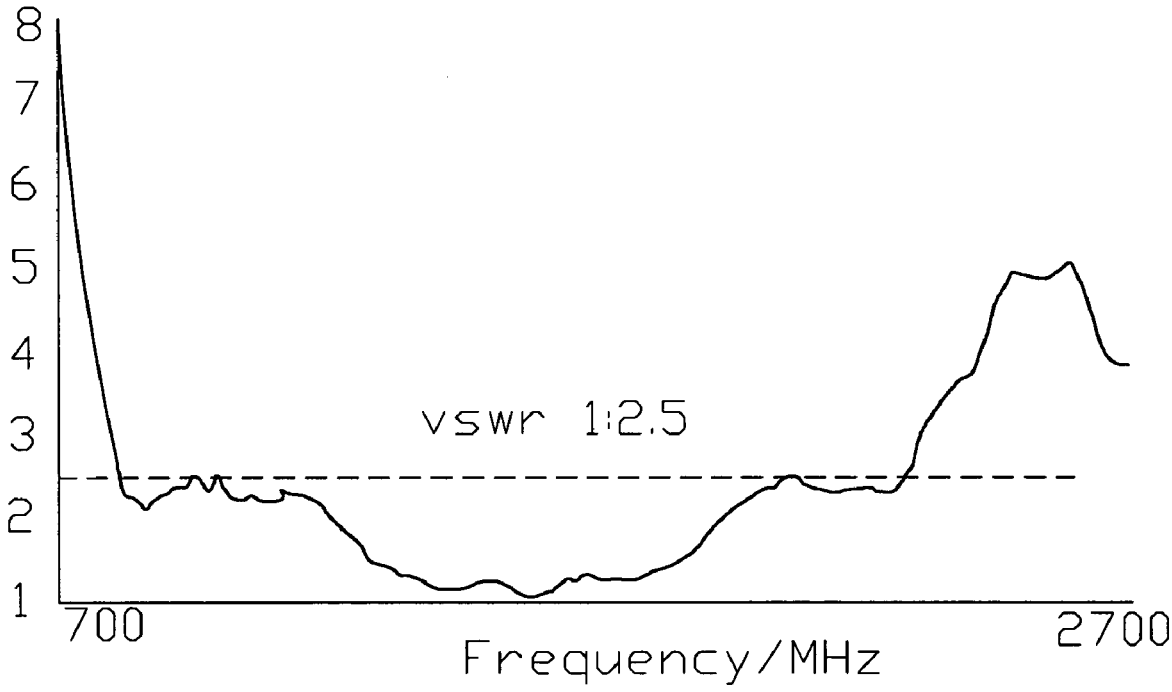
FIG. 6 is a standing wave ratio test graph of the present invention.
Figure 7A:
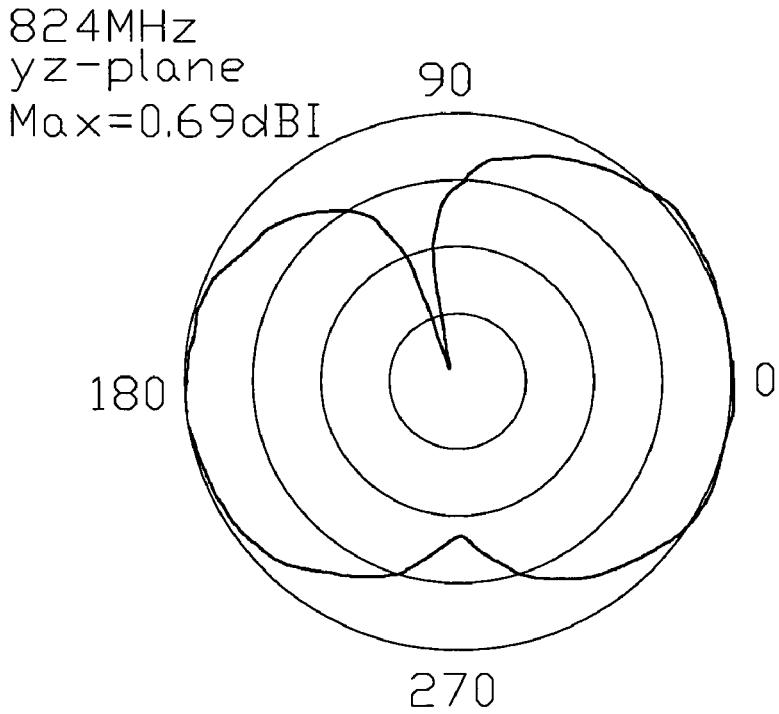
FIGS. 7A and 7B are diagrams of a radiation pattern of an E plane and an H plane under 824 MHZ of the present invention.
Figure 7B:
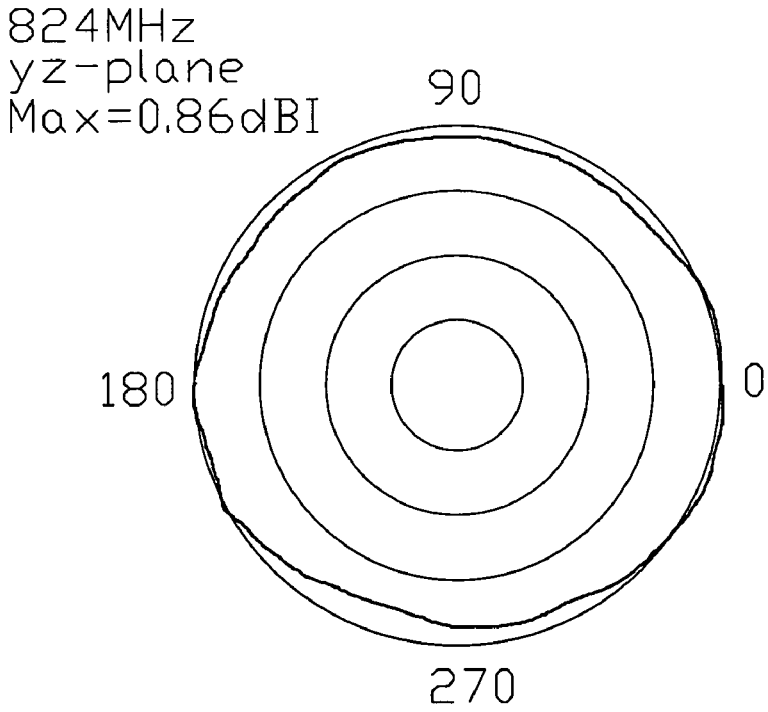
Figure 8A:
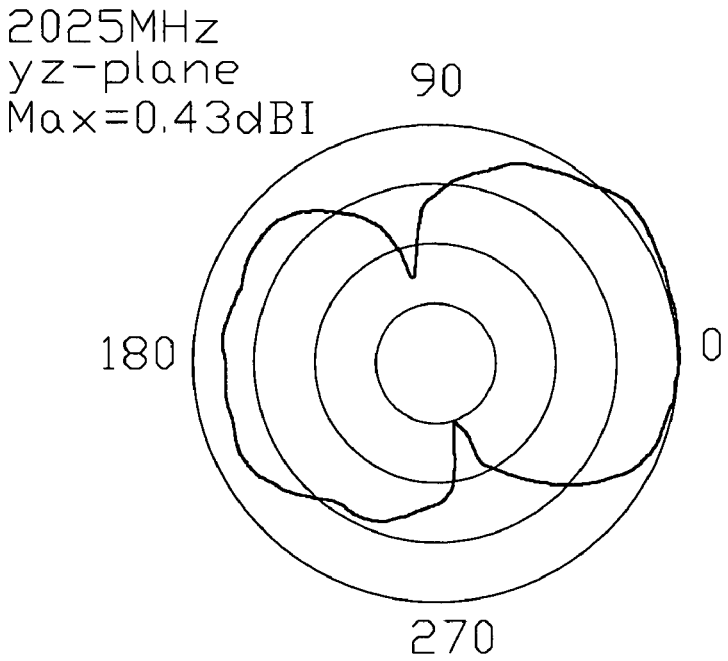
FIGS. 8A and 8B are diagrams of a radiation pattern of an E plane and an H plane under 2025 MHZ of the present invention.
Figure 8B:
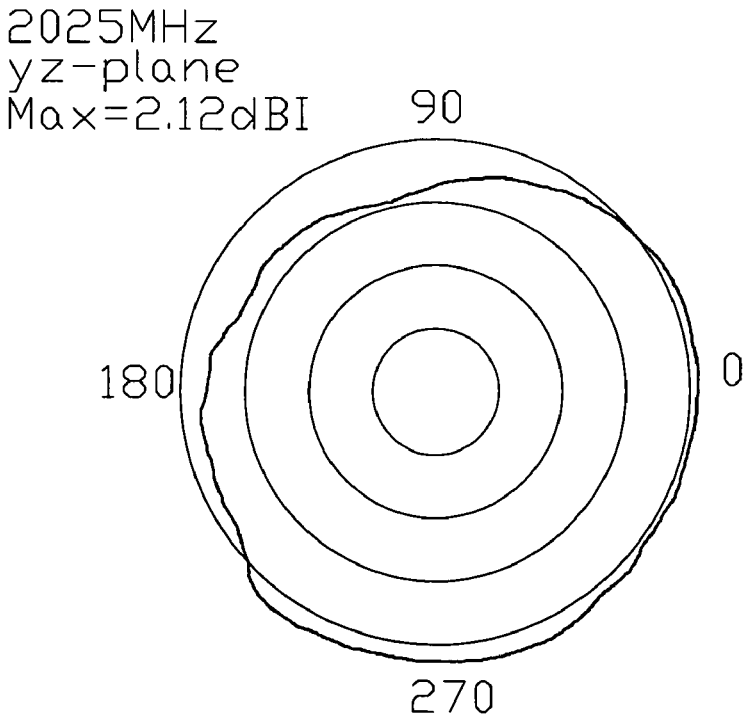

With the above structure, the present invention can get its desired broad bandwidth; when the above triangular cone (FIG. 2) is under test with the frequency of the global communication system (824-2025 MHZ), as is shown in FIG. 6, its standing wave ratio (VSWR) is smaller than or equal to 2.5 under the frequency of 780-2000 MHZ, this is quite ideal.

FIGS. 7A, 7B and 8A, 8B are diagrams of radiation patterns obtained respectively under the tests with 824 and 2025 MHZ. When using 824 MHZ, the maximum gain of an E plane (FIG. 7A) is 0.69 dBi, the maximum gain of an H plane (FIG. 7B) is 0.86 dBi; we can see from these radiation patterns that the H plane has a very excellent omni-directional radiation function. With the frequency of 2025 MHZ, the maximum gain of an E plane (FIG. 8A) is 0.43 dBi, the maximum gain of an H plane (FIG. 8B) is 2.12 dBi; we can see the H plane has a function near to that of the omni-directional radiation.

With the above designing of antenna, the present invention can have its impedance matching adjusted in pursuance of the gap between the component sheets, thereby the desired broad bandwidth can be adjusted according to the stacked height, and thereby the antenna can have excellent gain and feature of broadband.

The preferred embodiment disclosed above is only for illustrating and not for giving any limitation to the scope of the present invention. Taking a normal mobile phone as an example, the designing of antenna surely can be used on other wireless communication equipments. It will be apparent to those skilled in this art that various modifications or changes without departing from the spirit of this invention shall fall within the scope of the appended claims.

The invention claimed is:

1. A stacked monopole antenna for broadband communication equipment, wherein said antenna is provided with a plurality of component sheets arranged from bottom to top, a gap for adjusting impedance matching is provided between every two of said component sheets, an integral connecting neck is formed in said gaps between every two of said component sheets, a feed-in line is provided on a bottom of said antenna; said component sheets get its desired broad bandwidth by adjusting the height stacked by said component sheets, wherein said component sheets form together from bottom to top a sheet member, wherein said component sheets are rectangular forming together a rectangular stacked antenna, wherein every two of said component sheets have therebetween at least three connecting necks provided in the middle between two lateral sides of said component sheets.

2. The stacked monopole antenna for broadband communication equipment as defined in claim 1, wherein said antenna is installed in a housing, said feed-in line is extended out of said housing.

* * * * *